US007591458B2

(12) United States Patent
Maki

(10) Patent No.: US 7,591,458 B2
(45) Date of Patent: Sep. 22, 2009

(54) SHEET CONVEYANCE APPARATUS AND IMAGE FORMING APPARATUS

(75) Inventor: Tsuneo Maki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 10/538,285

(22) PCT Filed: Jan. 23, 2004

(86) PCT No.: PCT/JP2004/000615

§ 371 (c)(1),
(2), (4) Date: Jun. 7, 2005

(87) PCT Pub. No.: WO2004/067424

PCT Pub. Date: Aug. 12, 2004

(65) Prior Publication Data

US 2006/0033968 A1 Feb. 16, 2006

(30) Foreign Application Priority Data

Jan. 28, 2003 (JP) ..... 2003-018644

(51) Int. Cl.
*B65H 3/16* (2006.01)

(52) U.S. Cl. ..... 271/18.1; 271/275; 271/193

(58) Field of Classification Search ..... 271/18.1, 271/275, 193
See application file for complete search history.

(56) References Cited

U.S. PATENT DOCUMENTS 3,690,646 A * 9/1972 Kolibas ..... 198/691
4,244,465 A * 1/1981 Hishikawa et al. ..... 198/691
5,121,170 A * 6/1992 Bannai et al. ..... 399/303
5,316,282 A 5/1994 Fukube et al.
6,267,225 B1 7/2001 Compera et al.
6,375,184 B1 * 4/2002 Hayashi ..... 271/18.1
2002/0126193 A1 9/2002 Maki et al.

FOREIGN PATENT DOCUMENTS

CN 1202867 12/1998
EP 1238812 A1 9/2002

(Continued)

OTHER PUBLICATIONS

Jul. 5, 2007 European Search Report in connection with European patent application EP 04 70 4754.

(Continued)

*Primary Examiner*—David H Bollinger
(74) *Attorney, Agent, or Firm*—Cooper & Dunham, LLP

(57) ABSTRACT

A sheet conveyance apparatus can convey a recording paper (12) in a stable condition irrespective of a kind of the material of the recording paper (12). The sheet conveyance apparatus conveys a recording sheet (12) by attaching the recording paper (12) onto an endless conveyance belt (21) by applying electric charges onto a surface of the conveyance belt (21). A charger (26, 83) charges the surface of the conveyance belt (21) in a belt-like alternate voltage pattern (91). A control part (73) controls a charge width (L) of the alternate voltage pattern (91) in a direction of conveyance of the recording paper (12).

17 Claims, 11 Drawing Sheets

FOREIGN PATENT DOCUMENTS

| | | |
|---|---|---|
| JP | 3-256945 | 11/1991 |
| JP | 4-7236 | 1/1992 |
| JP | 4-51171 | 2/1992 |
| JP | 4-80141 | 3/1992 |
| JP | 7-53081 | 2/1995 |
| JP | 10-59573 | 3/1998 |
| JP | 2897960 | 3/1999 |
| JP | 2000-25249 | 1/2000 |

OTHER PUBLICATIONS

Mar. 21, 2008 Chinese official action in connection with corresponding Chinese patent application No. 2004800029127.
Sep. 26, 2008 official action in connection with a counterpart Japanese patent application No. 2003-018644.

* cited by examiner

SHEET CONVEYANCE APPARATUS AND IMAGE FORMING APPARATUS

TECHNICAL FIELD

This disclosure generally relates to image forming apparatuses and, more particularly, to a sheet conveyance apparatus for conveying sheets using a conveyance belt and an image forming apparatus using such a sheet conveyance apparatus.

BACKGROUND ART

An inkjet recording apparatus is used as an image recording apparatus (or may be referred to as image forming apparatus) such as a printer, a facsimile or a copy machine. The inkjet recording apparatus records an image on a recording sheet or recording paper by ejecting droplets of ink toward the recording paper from an ink recording head. The recording sheet is not limited to a regular recording paper but includes an OHP film, etc., and means an object onto which droplets of ink or developer can be applied. Hereinafter various kinds of recording sheet may be simply referred to as a recording paper or a sheet. The recording sheet may also be referred to as a medium to be recorded or a recording medium. The inkjet recording apparatus is capable of recording a high definition image at high speed. Moreover, the inkjet recording apparatus can be operated at a low running cost, and has little noise. Additionally, the inkjet recording apparatus has an advantage in that a color image is easily recordable using multicolor ink.

There is known an inkjet head having a thermal actuator, a shape memory alloy actuator or an electrostatic actuator, as an energy generating means for discharging ink. The thermal actuator uses a phase change caused by film boiling of a liquid by an electrothermal conversion element such as a piezoelectric element. The shape memory alloy actuator uses a phase change of metal caused by a temperature change. The electrostatic actuator uses an electrostatic force to discharge ink.

In the meantime, in an inkjet recording method, since ink is applied onto a recording paper, the recording paper may expand due to a water component contained in the ink. Such a phenomenon is referred to as cockling. A recording paper may become wavy due to cockling, which results in a change in a positional relationship between a nozzle of a recording head and the surface of the recording paper being recorded at a position to a position. If the magnitude of cockling becomes large, the recording paper may be brought into contact with the nozzle of the recording head in the worst case. In such a case, a nozzle surface of the recording head may become dirty or the recording paper itself may become dirty, which causes deterioration in image quality. Moreover, a landing position of an ink droplet may be shifted due to influence of cockling, and image quality is deteriorated also in such as case.

In order to solve the above-mentioned problems, an inkjet recording apparatus performs recording while locating a recording paper on a platen provided with a recess for absorbing cockling of the recording paper. Such a platen is used together with a spur having protrusions on an outer periphery thereof. However, there is a problem in that scratches are formed on an image on the recording paper by such a spur.

In the conventional inkjet recording apparatus, recording papers are conveyed by rollers. That is, for example, two pairs of rollers are arranged with a printing area located therebetween, and one of the pairs is a combination of a spur and a roller. However, according to such as structure, an accurate paper feed can be guaranteed only when a recording paper is engaged with both the tow pairs of rollers.

In recent years, there is a demand for increasing a recordable area of a recording paper. Thus, there is an inkjet recording apparatus which records an image on a recording paper so as to acquire a large recordable area even when the recording paper is in engagement with only one of the pairs of rollers, that is, when the paper feed accuracy cannot be guaranteed. However, there may be a problem occurs when the recording paper is lifted in a stated where the recording paper is in engagement with only one of the two pairs of rollers. Additionally, the paper feed accuracy cannot be guaranteed since a sufficient paper feed force cannot be acquired, which results in a problem of deterioration in image quality.

In order to pursue an improvement in image quality in an inkjet recording apparatus, there is a demand for improving an accuracy of landing position of an ink droplet. Accordingly, it is necessary to improve a flatness of a recording paper to be recorded. However, as mentioned above, when recording is performed with a regular recording paper, fibers in the recording paper may be deformed in a wavy shape due to a water component contained in ink, which results in a displacement in a landing position of the ink droplet (dot). Thus far, it is found that such a deformation of a recording paper appears considerably large after more than three minutes have passed after ink droplets landed on the recording paper.

As disclosed in Japanese Patent Publication No. 2897960 and Japanese Laid-Open Patent Application No. 7-53081, in order to acquire flatness of a recording paper, there is suggested an inkjet recording apparatus that uses an endless charge belt which is electrically chargeable so as to electrostatically attract the recording paper onto the surface of the charge belt so that the recording paper is conveyed by rotationally moving the charge belt. Since the recording paper is prevented from being separated from the surface of the charge belt due to the electrostatic attraction force, high-flatness of the recording paper can be maintained by the charge belt while an inkjet recording operation is performed.

More specifically, Japanese Patent Publication No. 2897960 discloses a paper conveyance apparatus and an image recording apparatus that charges the surface of the charge belt in an alternating pattern by contacting a voltage applying means onto the surface of the charge belt. Japanese Laid-Open Patent Application No. 7-53081 discloses a printing apparatus that discharges the charge belt using a discharge belt so as to acquire a stable potential on the surface of the charge belt.

In the meantime, a material of the recording paper used in an image forming apparatus such as an inkjet recording apparatus is not limited to one kind since an OHP sheet, etc., may be used other than a regular recording paper.

In the case where a recording paper is conveyed by being electrostatically attached onto a conveyance belt (the same as the conventional charge belt), an electrostatic attraction force is changed since a rate of dielectric polarization changes due to an influence of electric charge on the conveyance belt caused by a surface resistivity of the recording paper to being conveyed.

Accordingly, in the conventional paper conveyance apparatus and image forming apparatus, when a kind of a recording paper used is changed, a desired electrostatic attraction force may not be acquired, which may prevents the recording paper from being conveyed in a stable condition. Thus, there is a problem in that deterioration occurs in a conveyance stability and image quality.

SUMMARY

In an aspect of this disclosure, there is provided a sheet conveyance apparatus and image forming apparatus that can convey a recording sheet in a stable condition irrespective of a kind of the material of recording sheet.

In another aspect of this disclosure, there is provided a sheet conveyance apparatus for conveying a sheet by attaching the sheet onto an endless conveyance belt by applying electric charges onto a surface of the conveyance belt, the sheet conveyance apparatus comprising: a charger that charges the surface of the conveyance belt in a belt-like alternate voltage pattern; and a control part that controls a charge width of the alternate voltage pattern in a direction of conveyance of the sheet.

In an exemplary embodiment, the control part controls the charge width (or charge pitch) of the charge voltage pattern formed on the conveyance belt. Thus, the conveyance belt can be charged with an appropriate charge width (or charge pitch), thereby achieving a stable conveyance of the sheet such as a recording paper.

In the sheet conveyance apparatus according to an exemplary embodiment, the control part may control the charge width in accordance with a type of the sheet. The sheet conveyance apparatus may further comprise a sheet-type input part that inputs information regarding the type of the sheet to the control part.

Additionally, in the above-mentioned sheet conveyance apparatus, information regarding the type of the sheet may be given externally. The control part may control the charge width so that the charge width when the sheet contains a resin is smaller than the charge width when the sheet contains no resin. The control part may control the charge width so that the charge width when a surface resistivity of the sheet is equal to or smaller than $1\times10^{10}$ Ω/□ is set to be substantially equal to or greater than 4 mm and substantially equal to or smaller than 30 mm, and the charge width when a surface resistivity of the sheet is greater than $1\times10^{10}$ Ω/□ is set to be equal to or greater than 2 mm and equal to or smaller than 8 mm.

In the sheet conveyance apparatus according to an exemplary embodiment, the conveyance belt may have a two-layer structure comprising an insulating layer as an obverse layer and a medium resistance layer as a backside layer. A surface resistivity of the insulating layer may be substantially equal to or greater than $1\times10^{10}$ Ω/□, and a surface resistivity of the medium resistance layer may be substantially equal to or smaller than $1\times10^{8}$ Ω/□. Additionally, a thickness of the insulating layer may be substantially equal to or smaller than 60 μm, and a thickness of the backside layer may be substantially equal to or greater than 40 μm. A volume resistivity of a roller with which the conveyance belt is engaged may be substantially equal to or smaller than $1\times10^{10}$ Ω·cm.

Additionally, the sheet conveyance apparatus according to an exemplary embodiment may further comprise a discharger that removes or attenuates the charges on the surface of the conveyance belt, wherein the discharger may be located on an obverse side of the conveyance belt and a position out of an area where the sheet is brought into contact with the conveyance belt.

Further, in the sheet conveyance apparatus according to an exemplary embodiment, the control part may control a charged area of the conveyance belt when a surface resistivity of the sheet is substantially equal to or greater than $1\times10^{12}$ Ω/□ so that at least one of a leading edge portion and a trailing edge portion of the sheet is attached onto the conveyance belt, the leading edge portion being a range from a leading edge of the sheet to a position substantially equal to or less than 50 mm from the leading edge and the trailing edge portion being a range from a trailing edge of the sheet to a position substantially equal to or less than 100 mm from the trailing edge.

Additionally, in the sheet conveyance apparatus according to an exemplary embodiment, the control part may control the charge width so that the charge width is changed in accordance with a distance from a leading edge of the sheet.

Additionally, there is provided according to another aspect of this disclosure an image forming apparatus for forming an image on a sheet conveyed by a sheet conveyance apparatus conveying a sheet by attaching the sheet onto an endless conveyance belt by applying electric charges onto a surface of the conveyance belt, the sheet conveyance apparatus comprising: a charger that charges the surface of the conveyance belt in a belt-like alternate voltage pattern; and a control part that controls a charge width of the alternate voltage pattern in a direction of conveyance of the sheet.

Since the image forming apparatus has the above-mentioned sheet conveyance apparatus, the conveyance of the sheet is stabilized, which improves an image quality.

In the above-mentioned image forming apparatus, the conveyance belt may be charged before the sheet is fed to the conveyance belt. A charging operation to the conveyance belt may be stopped while an image is being formed on the sheet, and the charging operation may be performed on the conveyance belt when conveying the sheet by a specific distance.

In the above-mentioned image forming apparatus, a polarity of each charge in the voltage pattern may be changed in accordance with an amount of movement of the conveyance belt when the sheet is conveyed by the specific distance. The charge width of the voltage pattern may be an integral multiple of an amount of movement of the conveyance belt when conveying the sheet by the specific distance.

Additionally, there is provided according to another aspect of this disclosure an image forming apparatus for forming an image on a sheet conveyed by a sheet conveyance apparatus conveying the sheet by attaching the sheet onto an endless conveyance belt by applying electric charges onto a surface of the conveyance belt, the sheet conveyance apparatus comprising: a charger that charges the surface of the conveyance belt in a belt like alternate voltage pattern; a storing part that stores a relationship between a type of the sheet and a charge width of the alternate voltage pattern to be formed on the conveyance belt; and a control part that controls a charge width of the alternate voltage pattern in a direction of conveyance of the sheet in accordance with the type of the sheet based on the relationship stored in the storing part.

Further, there is provided according to another aspect of this disclosure a method for conveying a sheet by attaching the sheet onto an endless conveyance belt by applying electric charges onto a surface of the conveyance belt, comprising: charging the surface of the conveyance belt in a belt-like alternate voltage pattern; and controlling a charge width of the alternate voltage pattern in a direction of conveyance of the sheet in accordance with a type of the sheet based on a relationship between a type of the sheet and a charge width of the alternate voltage pattern to be formed on the conveyance belt.

Other aspects, features and advantages will become more apparent from the following detailed description when read in conjunction with the accompanying drawings.

BEST MODE FOR CARRYING OUT THE INVENTION

A description will be given below, with reference to the drawings, of embodiments of the present invention.

Figure 1:
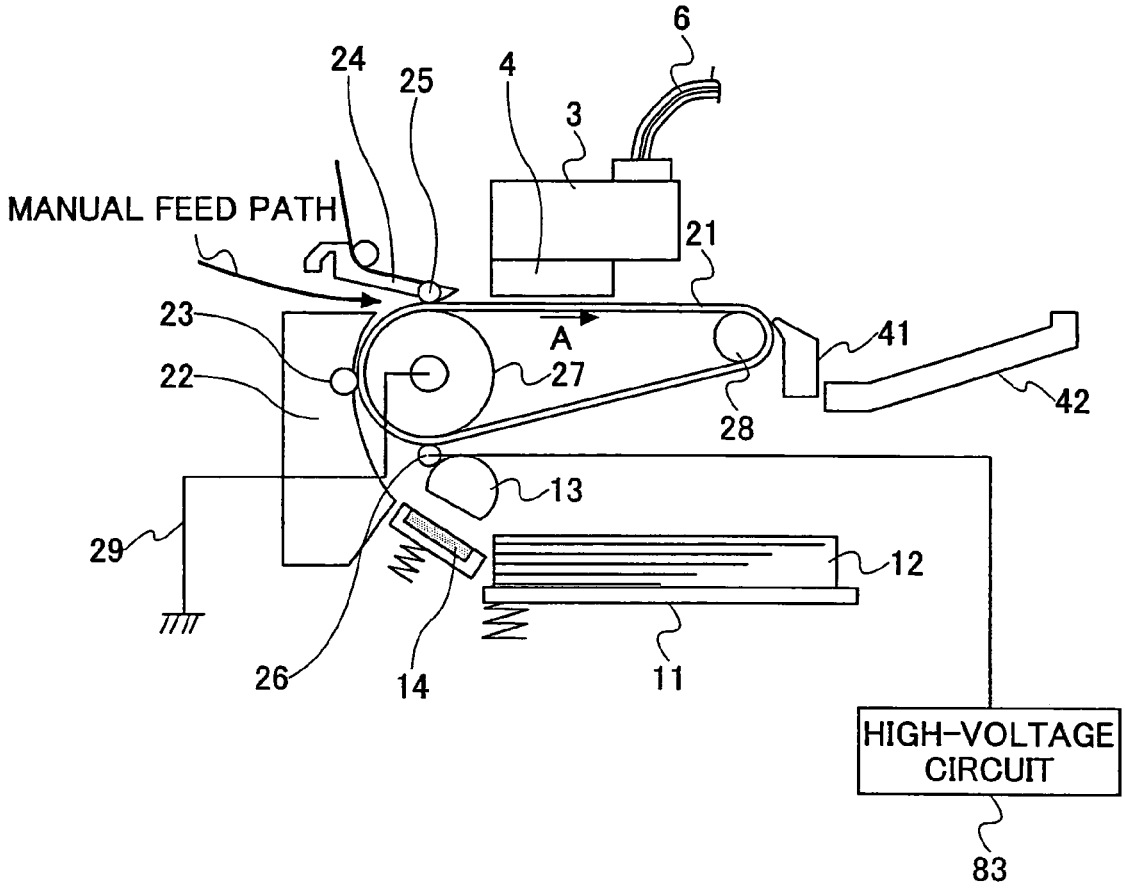
FIG. 1 is a structural diagram for explaining an inkjet recording apparatus according to a first embodiment of the present invention.
Figure 2:
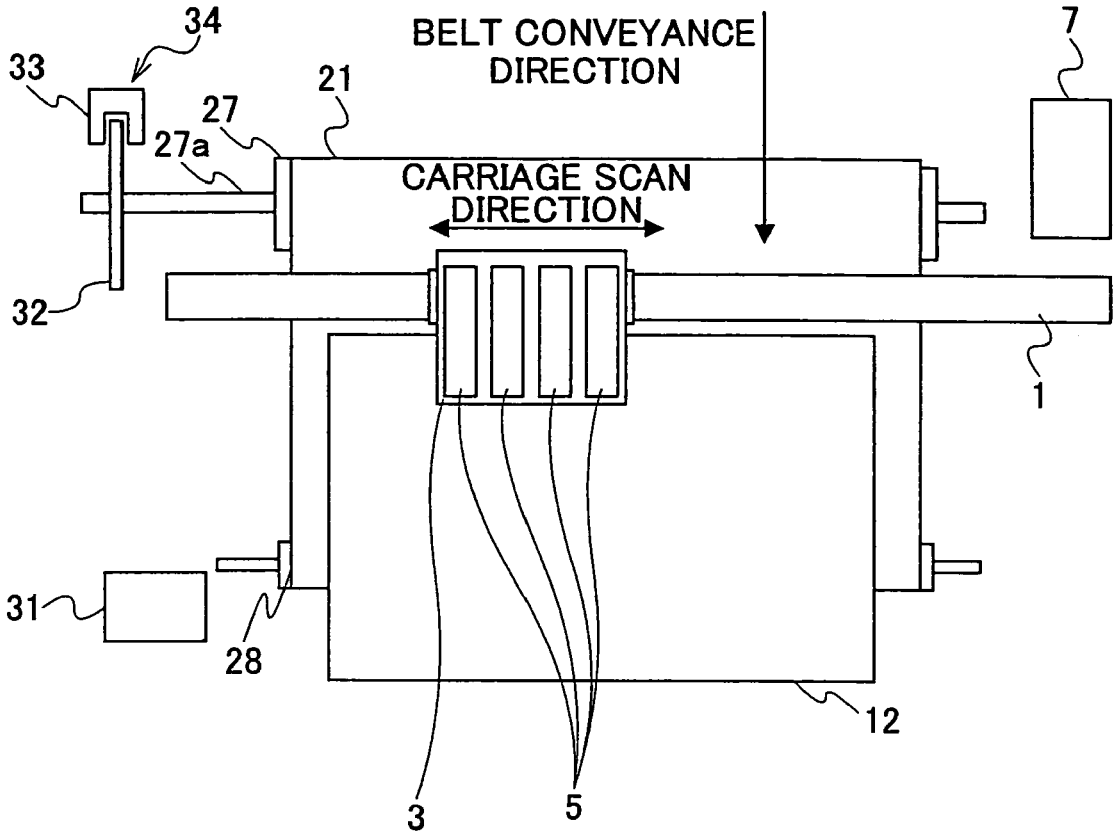
FIG. 2 is a plan view of the inkjet recording apparatus shown in FIG. 1.
Figure 3:
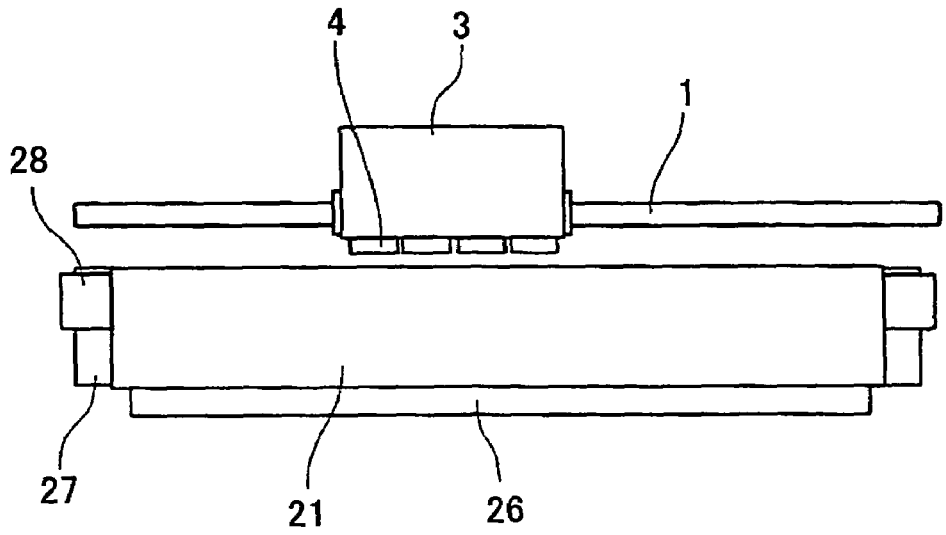
FIG. 3 is a front view of a part of the inkjet recording apparatus shown in FIG. 1.

A description will now be given, with reference to FIG. 1 through FIG. 3, of an inkjet recording apparatus serving as an image forming apparatus according to a first embodiment of the present invention. FIG. 1 is a structural diagram for explaining the inkjet recording apparatus according to the first embodiment of the present invention. FIG. 2 is a plan view of the inkjet recording apparatus shown in FIG. 1. FIG. 3 is a front view of a part of the inkjet recording apparatus shown in FIG. 1.

In the inkjet recording apparatus serving as an image forming apparatus, a carriage 3 is supported by a guide rod 1 and a stay (not shown in the figures) so that the carriage 3 is slidable in a main scanning direction. The guide rod 1 serves as a guide member mounted between left and right side plates (not shown in the figures). The carriage 3 is movable to scan in directions indicated by arrows in FIG. 2 by a main scanning motor 7 (refer to FIG. 2) through a timing belt.

The carriage 3 is provided with a recording head 4 having four inkjet heads that inject ink droplets in four colors such as yellow (Y), cyan (C), magenta (M) and black (Bk). The recording head 4 is mounted to the carriage 3 so that a plurality of ink outlet ports are arranged in a direction perpendicular to the main scanning direction and ink droplets are injected in a downward direction.

In the inkjet head that constitutes the recording head 4, a thermal actuator, a shape memory alloy actuator or an electrostatic actuator can be used as an energy generating means for discharging ink. The thermal actuator uses a phase change caused by film boiling of a liquid by an electrothermal conversion element such as a piezoelectric element. The shape memory alloy actuator uses a phase change of metal caused by a temperature change. The electrostatic actuator uses an electrostatic force to discharge ink.

Additionally, the carriage 3 is provided with sub tanks 5 of each color for supplying ink of each color to the recording head 4 in a replaceable manner. The ink of each color is supplied to the respective one of the sub tanks 5 from main tanks (not shown in the figures) through ink supply tubes 6, respectively.

The inkjet recording apparatus comprises a semilunar roller (feed roller) 13 and a separation pad 14 together serving as a paper feed part for feeding recording papers 12 placed on a paper loading part 11 such as a paper feed tray. The separation pad 14 is formed of a material having a large coefficient of friction, and is urged toward the feed roller 13. The paper feed part separates the recording papers 12 one after another and feeds the recording papers 12 from the paper loading part 11.

The inkjet recording apparatus further comprises conveyance belt 21, a conveyance guide 22, a counter roller 23, a pressing member 24, an end-pressing roller 25 and a charge roller 26. The conveyance belt 21 functions as a conveyance part for conveying the recording papers 12 fed from the paper feed part underneath the recording head 4 so as to convey the recording papers 12 by electrostatically attracting thereto. The conveyance guide 22 changes the feed direction of the recording papers 12 from a vertical direction to a horizontal direction so that the recording papers 12 are brought into contact with the conveyance belt 21. The counter roller 23 feeds the recording papers 12 fed from the paper feed part and guided by the conveyance guide 22 by sandwiching the recording papers 12 between the counter roller 23 and the conveyance roller 21. The end-pressing roller 25 is urged toward the conveyance roller 21 by being pressed by the pressing member 24. The charge roller 26 is a charging means for charging the surface of the conveyance belt 21 so as to generate an electrostatic attraction force.

The conveyance belt 21 is an endless belt, which is engaged with a conveyance roller 27 and a tension roller 28 that provides a tension to the conveyance roller 21. The conveyance belt 21 is rotated in the direction indicated by arrow A (belt conveyance direction) by driving the conveyance roller 27 by a sub-scanning motor 31 (refer to FIG. 2).

Figure 4:
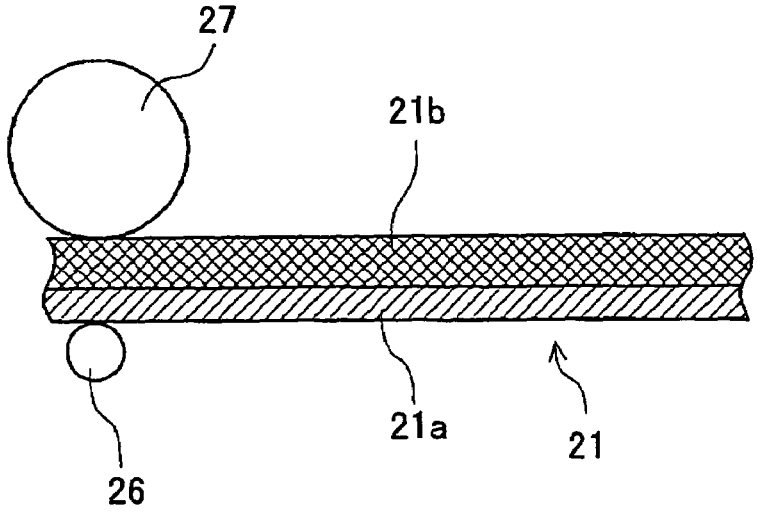
FIG. 4 is a cross-sectional view of a conveyance belt provided in the inkjet recording apparatus.

As shown in FIG. 4, the conveyance belt 21 has an obverse layer 21*a* and a backside layer (a medium resistance layer or a grounding layer) 21*b*. The obverse layer 21*a* is formed of a resin material such as a pure ETFE having a thickness of about 40 μm. The obverse layer 21*a* is not applied with a resistance control and forms a recording paper attraction surface. The backside layer 21*b* is formed of a material the same as the material of the obverse layer 21*a*, and is resistance control by carbon is applied thereto.

If the thickness of the obverse layer (insulating layer) 21*a* of the conveyance belt 21 is large, a dielectric constant decreases, which results in a decrease in an amount of electric charge retained on the conveyance belt 21 when it is electrically charged. According to experiments, a desired electrostatic attraction force was acquired by setting the thickness of the obverse layer 21*a* to be equal to or smaller than 60 micrometers. However, the electrostatic attraction force of the conveyance belt 21 can be increased by thinning the obverse layer 21*a* as small as possible in consideration of fluctuation of the film thickness in a manufacturing process and in a range where the thickness of the obverse layer 21*a* does not become zero even when a flaw is generated in the conveyance belt 21 in a practical use.

Although the thickness of the backside layer (a medium resistance layer or a grounding layer) 21*b* of the conveyance belt 21 does not give an influence directly to the electrostatic action, if a total thickness of the conveyance belt is large, a rigidity of the conveyance belt 21 increases and it becomes difficult to maintain a flatness of the conveyance belt 21 when being provided in a practical apparatus. However, in order to acquire a necessary strength, the backside layer 21*b* cannot be made thin too much. According to experiments, it was preferable to set the thickness of the backside layer 21*b* to about 40 to 200 μm.

As mentioned above, the conveyance belt 21 has a two-layer structure and provided with the resistance controlled backside layer 21*b* on an entire backside surface. Accordingly, when a recording paper to be attached is brought into contact with the conveyance belt 21 after an electric charge is applied to the obverse layer 21*a* which is an insulating layer, an electric charge is further supplied to the obverse layer 21*a*, thereby increasing the electrostatic attraction force between the recording paper and the conveyance belt 21. If the conveyance belt 21 is formed as a single insulating layer, the electrostatic attraction force is one half of the case where the conveyance belt 21 has the two-layer structure. Moreover, if the conveyance belt 21 is a single layer, a position at which the recording paper initially brought into contact with the conveyance belt 21 must be a position facing a grounding roller arranged on an inner side of the conveyance belt 21. However, such a limitation can be omitted by making the conveyance belt 21 with the two-layer structure.

In this case, a desired electrostatic force was obtained by using a material having a surface resistivity of equal to or greater than $1\times10^{10}$ Ω/□ for the obverse layer 21*a* and using a material having a surface resistivity of equal to or smaller than $1\times10^{8}$ Ω/□ for the backside layer 21*b*.

The conveyance roller 27, which drives the conveyance belt 21, serves as a grounding roller on the charge circuit. The conveyance roller 27 is formed of a material having a high coefficient of friction (high-μ) such as rubber for the purpose of driving the conveyance belt without slippage. Additionally, a certain level of volume resistivity is set to the conveyance roller 27 to provide an excessive current preventing function to the conveyance roller 27 so that a destruction of the conveyance belt 21 is prevented from progressing due to an excessive electric current flowing when an electric charging is being applied to the conveyance belt 21 having the insulating layer destructed by a flaw or the like and to prevent generation of a spark or generation of electric wave due to an unnecessary electric current. However, if the volume resistivity is too high, an impedance of the conveyance roller 27 on the charge circuit is excessively increased, which causes a problem in that a bias voltage applied to the conveyance belt 21 to form a charge on the conveyance belt 21 is increased. It was found experimentally that if the volume resistivity of the conveyance roller 27 serving as a grounding roller is equal to or smaller than $1\times10^{10}$ Ω·cm, the excessive current preventing function can be provided to the conveyance roller 27 at a level at which there is no influence to the bias voltage.

The charge roller 26 is arranged around the conveyance belt 21 so as to be in contact with the surface of the conveyance roller 21 and rotated by the rotational movement of the conveyance belt 21. Each end of the axis of the charge roller 26 is applied with a pressing force of 2.5 N. Moreover, the conveyance roller 27 also serves as a grounding roller, which contacts with the medium resistance layer of the conveyance belt 21 so as to ground the conveyance belt 21 through a ground line 29.

Further, the inkjet recording apparatus is provided with a paper ejecting part for ejecting the recording paper 12 on which an image is recorded by the recording head 4. The paper ejecting part comprises a separating part 41 for separating each recording paper 12 from the conveyance belt 21 and a paper eject tray 42 for accommodating the ejected recording papers 12.

Figure 5:
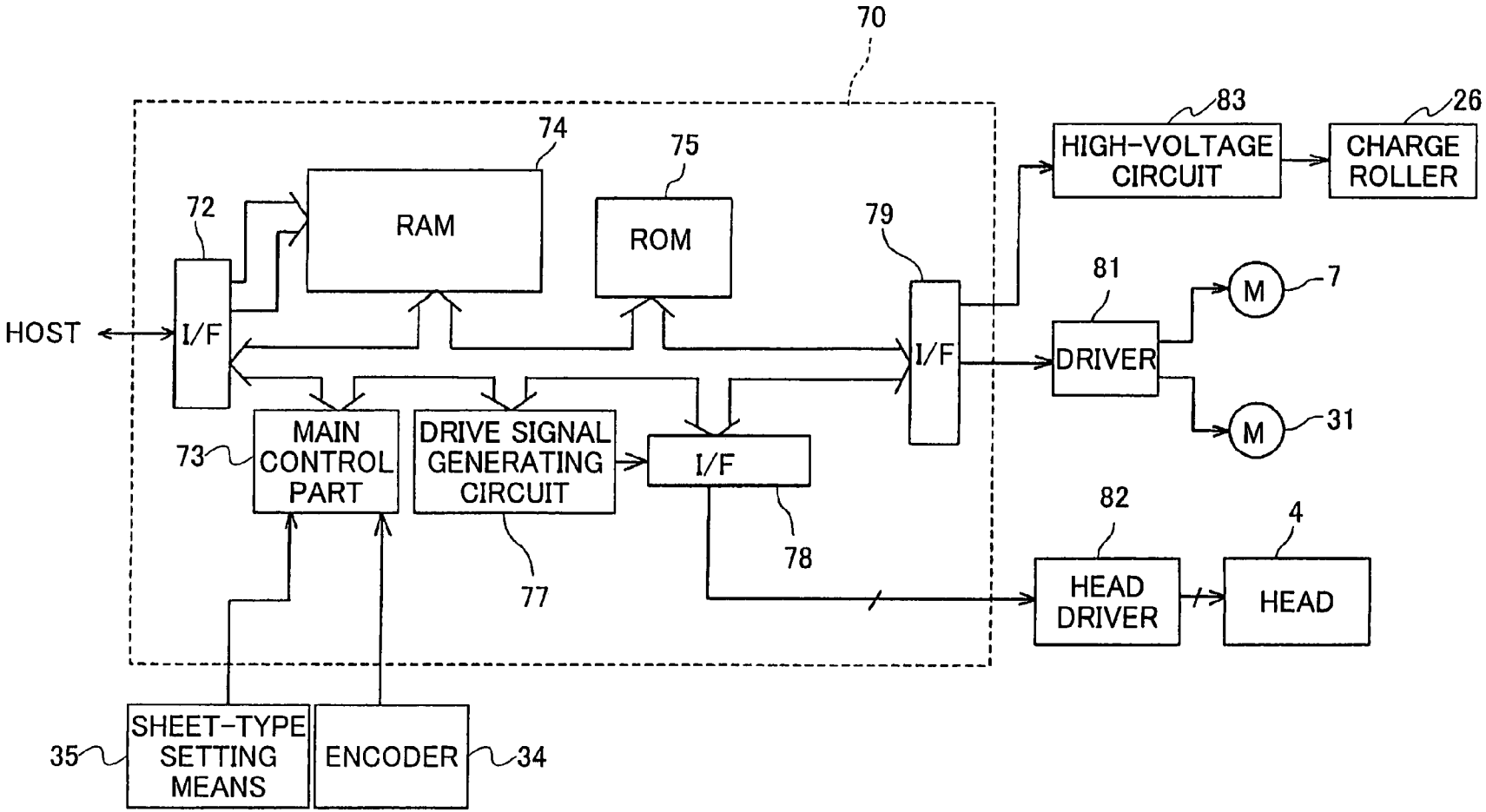
FIG. 5 is a block diagram of an entire control part of the inkjet recording apparatus.

A description will be given, with reference to FIG. 5, of a control part of the inkjet recording apparatus. FIG. 5 is a block diagram of the entire control part of the inkjet recording apparatus. The control part comprises a printer controller 70, a motor driver 81 for driving the main scanning motor 7 and the sub-scanning motor 31, and a head driver 82 (constituted by a head drive circuit, a driver IC, etc.) for driving the recording head 4 (inkjet head).

The printer controller 70 comprises an interface (hereinafter referred to as I/F) 72, a main control part 73, a RAM 74, a ROM 75, a drive signal generating circuit 77, an I/F 78 and an I/F 79. The I/F 72 receives, through a cable or a network, print data sent by a host side including an information processing apparatus such as a personal computer, an image reading apparatus such as a scanner, an imaging apparatus such as a digital camera, etc. The main control part 73 includes a CPU, a ROM, a RAM, an I/F, etc., so as to functions as means for changing a width of voltage pattern on the conveyance belt 21 concerning the present invention. The RAM 74 stores various sets of data and information. The ROM 75 stores routine or programs for processing various sets of data. The drive signal generating circuit 77 generates a drive waveform supplied to the recording head 4. The I/F 78 is an interface for sending print data, which is developed in dot pattern data (bit map data) and the drive waveform data to a head driver 84. The I/F 79 is an interface for sending motor drive data to a motor driver 81 and sending a signal for controlling an output of a high-voltage circuit which applies a high voltage (charge voltage) to the charge roller 26.

The main control part 73 is supplied with signals from various sensors and switches. That is, the main control part 73 is supplied with an output of an encoder 34, which is constituted by a photosensor 33 and a slit plate 32 fixed to a shaft 27*a* of the conveyance roller 27 rotationally driven by the sub-scanning motor 31 as shown in FIG. 2. Additionally, the main control part 73 is supplied with a signal from a paper type designating means (constituted by a switch or menu selection means) provided on an operational panel (not shown in the figures) for designating a type of recording paper to be used. Moreover, the information which designates a type of the recording paper to be used can be provided by a printer driver of a host side. Based on an amount of rotation, that is, an amount of movement of the conveyance roller 27 and a designated type of the recording paper to be used, the main control part 73 controls the high-voltage circuit 83 so as to control the electric charge of conveyance belt 21.

The RAM 74 is used as various buffers and work memories. The ROM 75 stores various sets of information and data such as various control routines, font data and graphic functions, various procedures, fixed information (table information) of a relationship between a type a recording paper and a width of a charge voltage pattern formed on the conveyance belt 21, etc.

The main control part 73 reads and analyzes print data stored in a reception buffer contained in the I/F 72, and stores the obtained results of analysis (intermediate code data) in a predetermined area of the RAM 74. Then, the main control part 73 produces dot pattern data used for outputting image data from the stored results of analysis by using font data stored in the ROM 75, and stores the dot pattern data in a different predetermined area of the ROM 74. It should be noted that when image data is developed on a bit map data by a printer driver of the host side and is transferred to the inkjet recording apparatus, received image data of bit map is merely stored in the RAM 74.

When dot pattern data corresponding to one line of the recording head 4 is obtained, the main control part 73 sends the dot pattern data of one line to a head driver 82 as serial data through the I/F 78 in synchronization with a clock signal CLK from an oscillating circuit. Moreover, the main control part 73 sends a latch signal to the head driver 82 at a predetermined timing.

The drive signal generating circuit 77 is constituted by a waveform generating circuit and an amplifier, and includes a ROM (may be constituted by the ROM 75) storing the pattern data of a drive waveform (drive signal) and a digital-to-analog (D/A) converter which carries out a D/A conversion of the data of the drive waveform read from the ROM.

The head driver 82 comprises: a shift register which inputs clock signal and the serial data which is print data from the main control par 73; a latch circuit which latches a registered value of the shift register according to the latch signal from the main control part 73; a level conversion circuit (level shifter) which changes a level of an output value of the latch circuit; and an analog switch array (switching means) of which ON/OFF is controlled by the level shifter. The head driver 82 selectively supplies to the recording head 4 the necessary drive waveform contained in the drive waveform by controlling ON/OFF of the analog switch array.

In the thus-constructed inkjet recording apparatus, the recording papers 12 are separated one by one and fed from the paper feed part. Each recording paper 12 is guided by the conveyance guide 22, and is fed by being pinched between the conveyance belt 21 and each of the counter roller 23 and the end-pressing roller 25.

Figure 6:
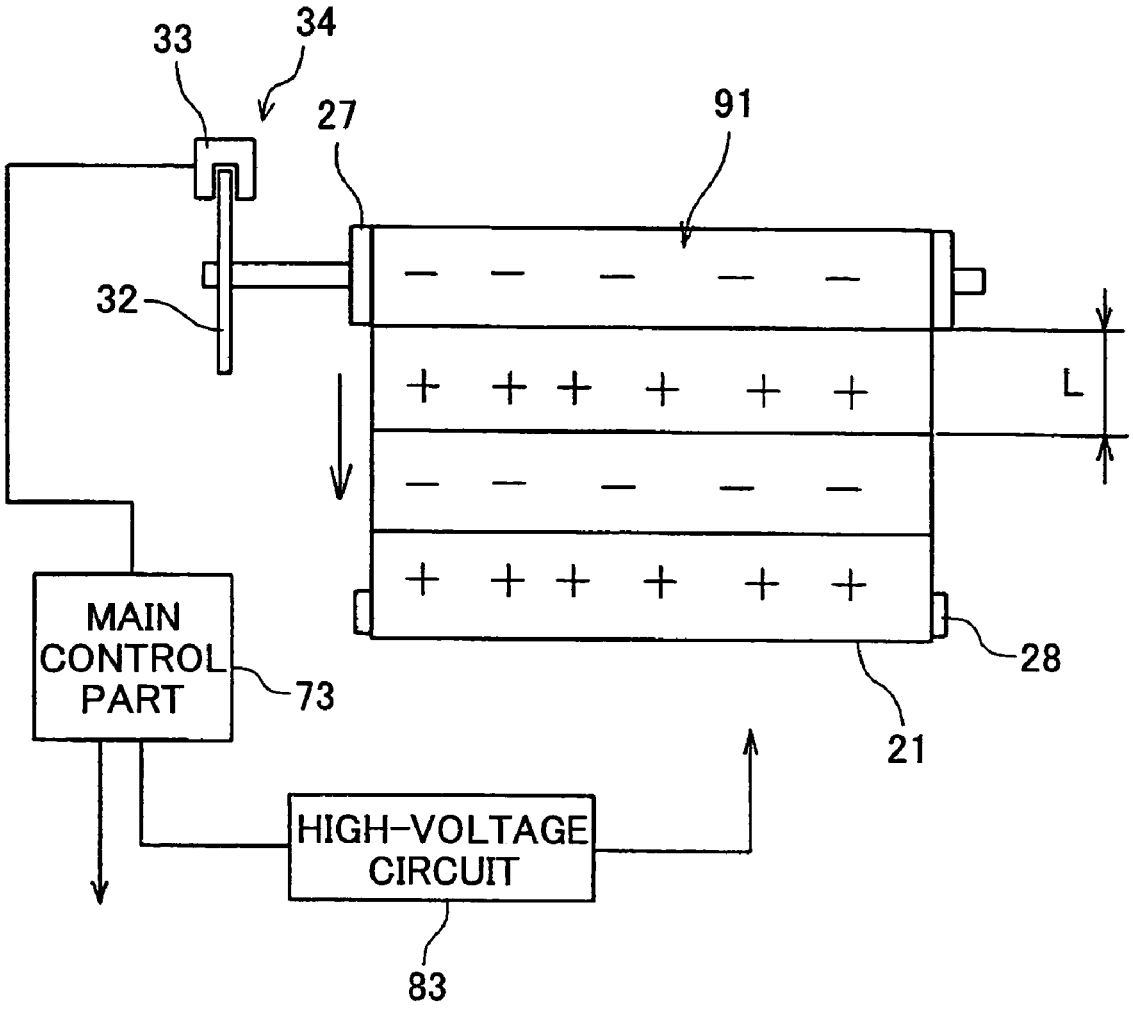
FIG. 6 is an illustration for explaining a charge voltage pattern formed on a conveyance belt.

While each recording paper 12 is being fed, the main control part controls the high-voltage circuit 83 (high-voltage source) to apply a plus output and a minus output to the charge roller 26, that is, an alternating voltage is applied to the charge roller 26. Thereby, as shown in FIG. 6, the surface (the obverse layer 21*a* (insulating layer)) of the conveyance belt 21 is charged in a belt-like voltage pattern 91 having alternating polarities (hereinafter, referred to as charge voltage pattern). That is, the conveyance belt 21 is charged plus and minus alternately with a predetermined width (referred to as a charge width (or a charge pitch)) in the sub-scanning direction which is a rotating direction of the conveyance belt 21.

Figure 7A:
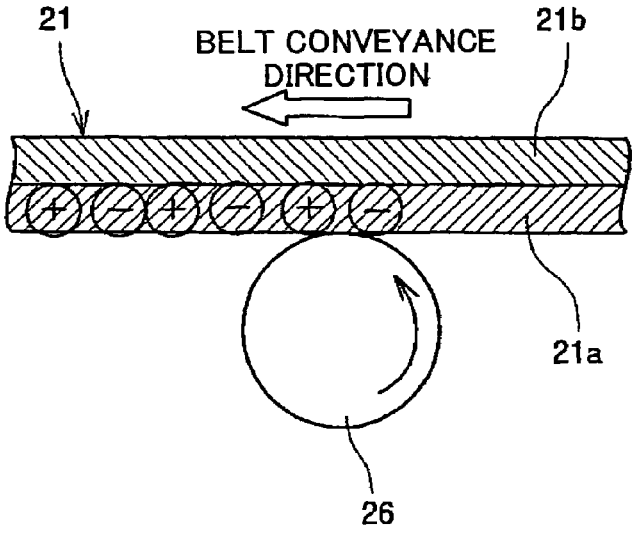
FIG. 7A is an illustration for explaining charges applied from a charge roller to the conveyance belt.

A description will now be given, with reference to FIGS. 7A and 7B, of an attraction of a recording paper by an electric charge formed on the conveyance belt 21. As shown in FIG. 7A, a charge voltage pattern 91 is formed on the obverse layer (insulating layer) 21*a* of the conveyance belt 21 by the charge roller 26 applying positive and negative electric charges at the same potential with a certain width.

Figure 7B:
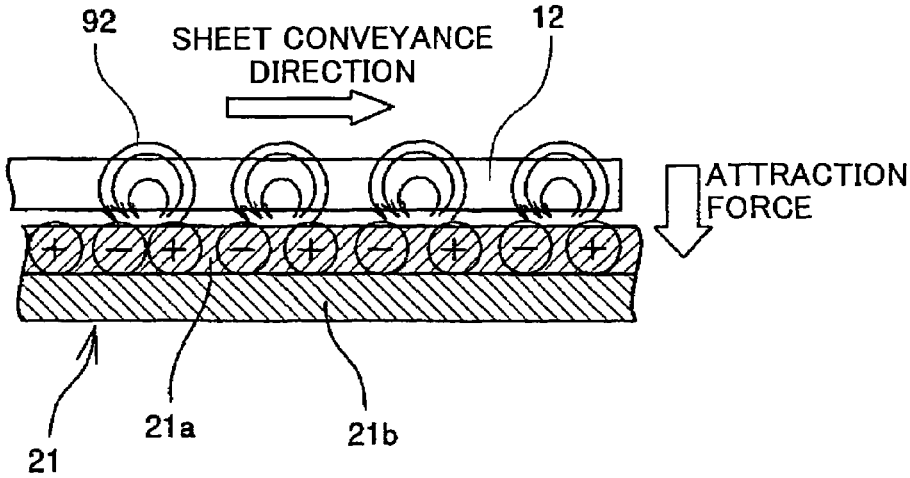
FIG. 7B is an illustration for explaining generation of an attraction force exerted on a recording paper.

In this state, if a recording paper 12 begins to contact with the conveyance belt 21 as shown in FIG. 7B, magnetic lines 90 are generated on the surface of the conveyance belt 21 from each of the plus electric charges to an adjacent minus electric charge. Due to the influence of the magnetic lines 92, electric charges of the same polarity are induced on a side of the recording paper 12 opposite to the side where the recording paper 12 is in contact with the conveyance belt 21. The magnetic line density on the side where the recording paper 12 is in contact with the conveyance belt 21 is higher than that of the side where the recording paper 12 is not in contact with the conveyance belt 21. Thus, there is a difference generated in the electric charges between the upper side and the lower side of the recording paper 12, which generates a force (Maxwell stress) toward the conveyance belt 21 is exerted on the recording paper 12. Thereby, the recording paper 12 is attracted by the conveyance belt 21, and the recording paper 12 is conveyed by rotational movement of the conveyance belt 21 in the sub-scanning direction.

In this case, the charge width L of the charge voltage pattern 91 formed on the conveyance belt 21 is controlled as follows. First, as shown also in FIG. 6, an amount of conveyance (movement) of the conveyance belt 21 is obtained (calculated) based on an output of the encoder 34 that detects an amount of rotation of the conveyance roller 27. Then, an amount of movement of the conveyance belt 21 is controlled by controlling by the main control part 73 the sub-scanning motor 31, which drives the conveyance roller 27. Simultaneously, an output of the high-voltage circuit (high-voltage source) 83, which applies a high voltage to the charge roller 26 (charge apparatus) to charge the conveyance belt 21, is controlled to be switched between a positive voltage (plus) and a negative voltage (minus).

Thus, the recording paper 12 is conveyed by the conveyance belt, which has been charged alternately at plus and minus, and stopped at a recording position, and, then, recording of one line is performed by injecting ink droplets toward the recording paper 12 by operating the recording head 4 while moving the carriage 3 in accordance with image signals. Then, when the recording of one line is completed, the conveyance belt 21 is driven so as to move the recording paper 12 by a predetermined distance, and, thereafter, recording of the next line is performed. Upon receipt of a recording end signal or a signal indicating that the trailing edge of the recording paper 12 reached the recording area, the recoding operation is ended, and the recording paper 12 is ejected onto the paper eject tray 42.

It should be noted that a recovery device for recovering failure of injection of the recording head 4 is located at a position out of the recording area on one side in the direction of movement of the carriage 3. During standby, the carriage 3 moves to a side near the recovery device so as to maintain the recording head 4 in a moist state by capping the recording head 4 by a capping means, which prevents failure of injection due to dried ink. Moreover, ink droplets irrelevant of recording may be injected during recording so as to maintain the viscosity of all ink to maintain a stable injection property.

Moreover, when a failure occurs in injection of ink, the nozzle of the recording head 4 is sealed so as to suction air bubbles together with ink by a suctioning means through a tube. Thereby, ink, dirt, etc., adhering onto the nozzle surface are removed by a cleaning means, and a n operation for recovering a failure of injection is performed.

Figure 8:
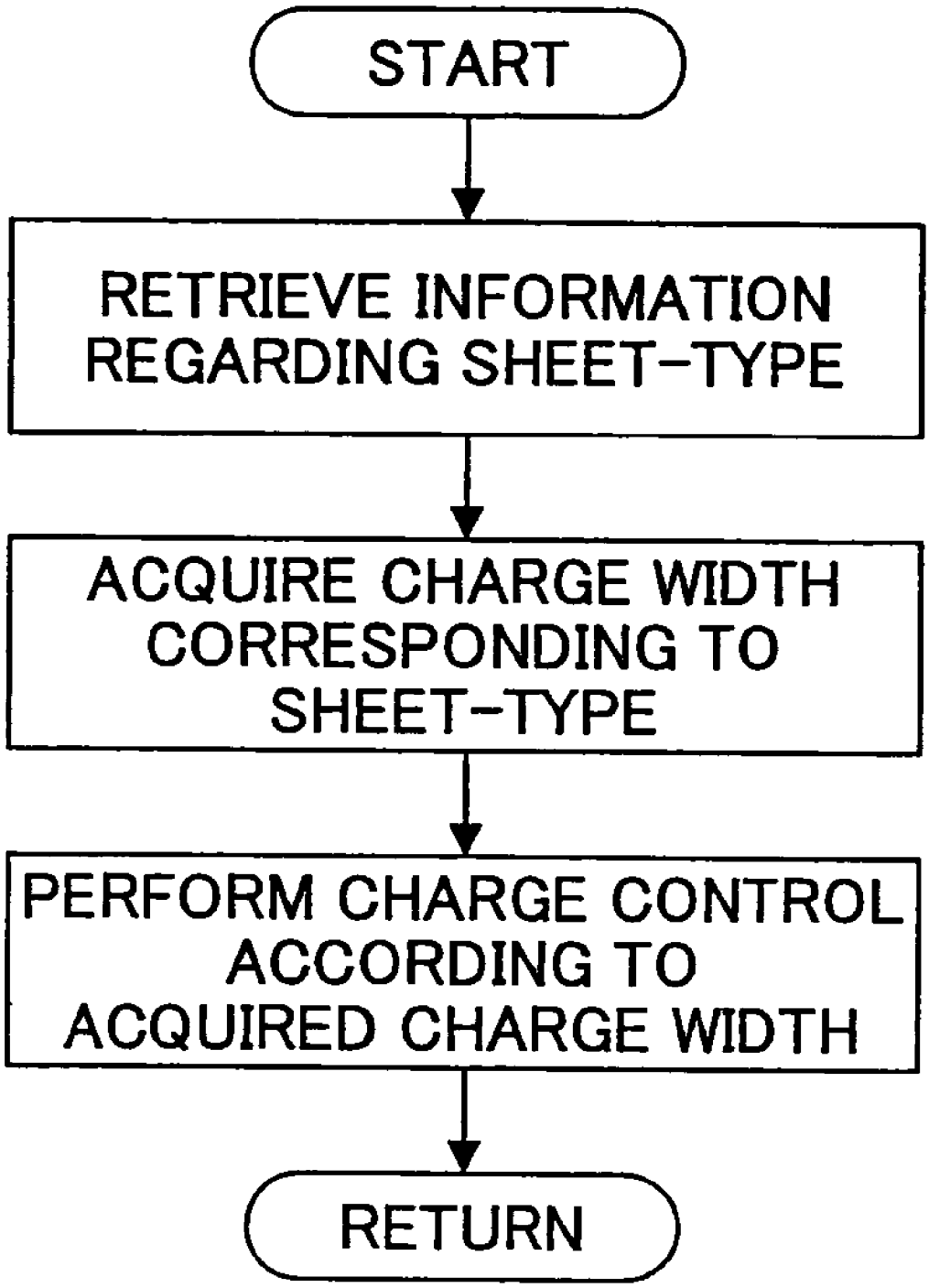
FIG. 8 is a flowchart for explaining a control of a charge width of a charge voltage pattern.

A description will now be given, with reference to FIG. 8 and subsequent drawings, of a control of a charge voltage pattern formed by the inkjet recording apparatus. Referring to FIG. 8, the main control part 73 retrieves paper type information given by a sheet-type designating means 35 or a printer driver on the host side. That is information regarding the sheet-type of the recording sheet to be conveyed is input from the sheet-type designating means 35, which serves as a sheet-type input part for inputting the information regarding the sheet-type to the main control part 73, or the information is supplied from an external part such as the printer driver on the host side. Moreover, the main control part 73 retrieves charge width information corresponding to a designated paper type from the table regarding the relationship between paper types and charge widths stored in the ROM 75.

Then, the main control part 73 controls ON/OFF and plus/minus switching of the output of the high-voltage circuit 83 so as to switch the polarity of the voltage applied to the charge roller 26 based on the retrieved charge width information and information regarding an amount of rotation of the conveyance roller 27 detected by the encoder 34 (an amount of movement of the conveyance belt 21). Thereby, the charge width L of the charge voltage pattern 91 formed on the conveyance belt 21 is controlled so as to be equal to the pitch corresponding to the type of the recording paper 12 to be conveyed.

The attraction force exerted on the recording paper by the conveyance belt 21 is influenced by a width of the charged areas on the conveyance belt 21. That is, a rate of dielectric polarization influenced by charges on the conveyance belt changes dependent on a surface resistivity of an object to be carried, which changes the electrostatic attraction force generated by the conveyance belt. Thus, if the surface resistivity of the recording paper is changed due to a change in an amount of water contained in the recording paper or a material forming the surface of the recording paper, the attraction force exerted on the recording paper with respect to the conveyance belt on which alternating charges of plus and minus is changed.

Here, since the surface resistivity of recording papers can be classified according to types or kinds of the recording papers, the conveyance belt can be charged with an appropriate charge width in accordance with the recording paper to be conveyed by adjusting (changing) the charge width according to the type or kind of the recording paper. Accordingly, a stable attraction force can be generated by the conveyance belt, thereby achieving a high conveyance quality and forming an image with high quality.

Moreover, since the surface resistivity of a recording paper fluctuates due to changes in the environmental conditions (temperature, humidity), a detecting means (temperature sensor, humidity sensor) for detecting the environmental conditions may be provided so as to control the charge width based on the detected environmental conditions, thereby achieving a more appropriate attraction force.

Here, a description will now be given of a case where a recording paper to be conveyed is a regular paper. Generally, the surface resistivity of a regular paper is about $1\times10^{7}$ Ω/□. In the case of a regular paper, a charge of a polarity opposite to a polarity of a charge on the conveyance belt 21 is induced on the surface of the recording paper 12, which is brought into contact with the conveyance belt 21. Accordingly, in the electrostatic attraction method according to the present embodiment, in addition to the above-mentioned electrostatic attraction force (Maxwell stresses), the charge on the conveyance belt 21 and the charge induced on the recording paper 12 electrostatically attract each other, which causes a force that attract the recording paper 12 to the conveyance belt 21. The attraction force caused by the dielectric charge is stronger than the Maxwell stresses.

The rate of generation of the dielectric charge varies according to the surface resistivity of a recording paper. If the surface resistivity is high (exceeds $1\times10^{10}$ Ω/□), the dielectric charge is small and the attraction of the recording paper depends on the above-mentioned Maxwell stresses.

Moreover, the attraction force according to the dielectric charge tends to increase as the charge width increases within a range where the charge width L is equal to or greater than 4 mm and equal to or smaller than 30 mm. On the other hand, the attraction force according to the Maxwell stresses becomes efficient as there are may switching points between plus and minus charges, that is, as the charge width decreases.

Thus, if the surface resistivity of an object to be conveyed is equal to or smaller than $1\times10^{10}$ Ω/□, a regular paper can be conveyed, generally, in a stable condition by setting the charge width equal to or greater than 4 mm and equal to or smaller than 30 mm. That is, it is preferable to set the charge width, when conveying a regular paper, to a value equal to or greater than 4 mm and equal to or smaller than 30 mm.

On the other hand, the surface resistivity of a recording paper containing a resin such as an OHP sheet (hereinafter, simply referred to as an "OHP" is a value exceeding $1\times10^{10}$ Ω/□ unless a solution for controlling the resistance is applied onto the contact surface of the recording paper which is brought into contact with the conveyance belt 21. Accordingly, the attraction force in the case of attaching an OHP to the conveyance belt 21 is smaller than that of the case of a recording paper having a surface resistivity of $1\times10^{7}$ Ω/□.

If the surface resistivity is high, the attraction force according to the Maxwell stresses generated in edge portions where the plus and minus charges on the conveyance belt 21 are switched becomes dominant over the electrostatic action according to the dielectric polarization. That is, a larger attraction force can be generated for an object to be conveyed having a high surface resistivity as there are more switching points between plus and minus charges, that is, as the charge width decreases.

Thus, if the surface resistivity of an object to be conveyed exceeds $1\times10^{10}$ Ω/□, a stable conveyance can be achieved by setting the charge width within a range equal to or greater than 2 mm and equal to or smaller than 8 mm. That is, the charge width when conveying an OHP, is preferably within the range equal to or greater than 2 mm and equal to or smaller than 8 mm. It should be noted that the reason for setting the lower limit of the charge width to 2 mm is that, if it is smaller than 2 mm, the charges are cancelled, which is the same as an uncharged state as mentioned later.

A description will now be given of a relationship between a timing of starting a charging operation for the conveyance belt 21 and a timing of feeding the recording paper 12 onto the conveyance belt 21. In the inkjet recording apparatus mentioned above, the recording paper 12 to be fed is conveyed by separating it from the pile of recording papers by the paper feed roller 13. Here, when printing the recording papers 12 continuously or printing a plurality of recording papers, there may happen a case where a leading edge of one of the recording papers 12 to be held gradually moves in the direction of conveyance and the leading edge may be located in the vicinity of the conveyance belt 21.

Moreover, depending on the layout of the image forming apparatus, a distance between the location where the recording papers are piled and the location where the recording paper 12 is brought into contact with the conveyance belt 21 may be smaller than a distance between the charge apparatus (charge roller) on the conveyance belt 21 and the location where the recording paper 12 is brought into contact with the conveyance belt 21.

In such a case, is becomes impossible to form a charge on the surface of the conveyance belt front face, which faces a leading edge of the recording paper.

Thus, before separating and feeding the recording paper 12 so as to perform a print on the recording paper 12, the conveyance belt 21 is driven in a condition where the paper feed roller 13 is not driven and an output of the high-voltage circuit 83 is applied to the charge apparatus (charge roller) 26 so as to charge the conveyance belt 21.

As mentioned above, the paper feed roller 13 is driven after forming charges with a desired charge width on the conveyance belt 21 so as to separate and feed the recording paper 12, and the recording paper 12 is conveyed to a position directly under the recording head in a state where the recording paper 12 is attracted onto the conveyance belt 21, and, then, printing is started.

Thereby, it is prevented that a non-charged area is generated in an area where the conveyance belt is in contact with the recording paper 12, which achieves a stable conveyance of the recording papers.

A description will now be given of a relationship between a size of the recording paper 12 and an overall length of the conveyance belt 21. If the conveyance belt 21 is charged while being continuously driven at a constant speed, the output of the high-voltage circuit 83 applied to the charge roller 26 can be a constant frequency. Accordingly, the specification of the high-voltage circuit 83 can be simplified.

Here, if charges are formed beforehand on the conveyance belt 21 and the recording paper 12 is conveyed sorely by the formed charges, and when the overall length of the conveyance belt 21 is smaller than the size of the recording paper 12, the recording paper 12 is attached to the conveyance belt 21 on a leading edge side but the recoding paper on a trailing side is attached onto the recording paper 12 itself.

In such a case, if the recording paper 12 is once separated from the conveyance belt 21, the charges on the conveyance belt 21 are attenuated. Therefore, in a case where the recording paper 12 having a length longer than the overall length of the conveyance belt 21 is conveyed, the attraction force exerted on a portion near the trailing edge of the recording paper 12 is very small.

Thus, in the present embodiment, when an image formation is performed by the recording head 4 while the conveyance belt 21 is stopped, the charging operation to the conveyance belt 21 by the charge roller 26 is also stopped, but the charging operation is performed when moving the conveyance belt 21 by a desired distance for line feed. Thereby, the charges on the conveyance belt with respect to the recording paper can always be maintained constant and a stable attraction force can be obtained.

In the case where the charging operation if performed during a line feed (while the conveyance belt 21 is moved by a desired distance), there is a case where there are a plurality of line feed amounts in some image forming apparatuses. For example, there is a case where an image is formed with a pixel density larger than a nozzle pitch. That is, there may be a plurality of line feed amounts in accordance with a pixel density of an image to be formed.

On the other hand, the paper attraction force of the electrostatic attraction conveyance method varies depending on the charge width (charge pitch) of the charge voltage pattern of plus and minus charges, and also varies depending on the types of the recording paper, and there is an optimum charge width for each environment.

Figure 9:
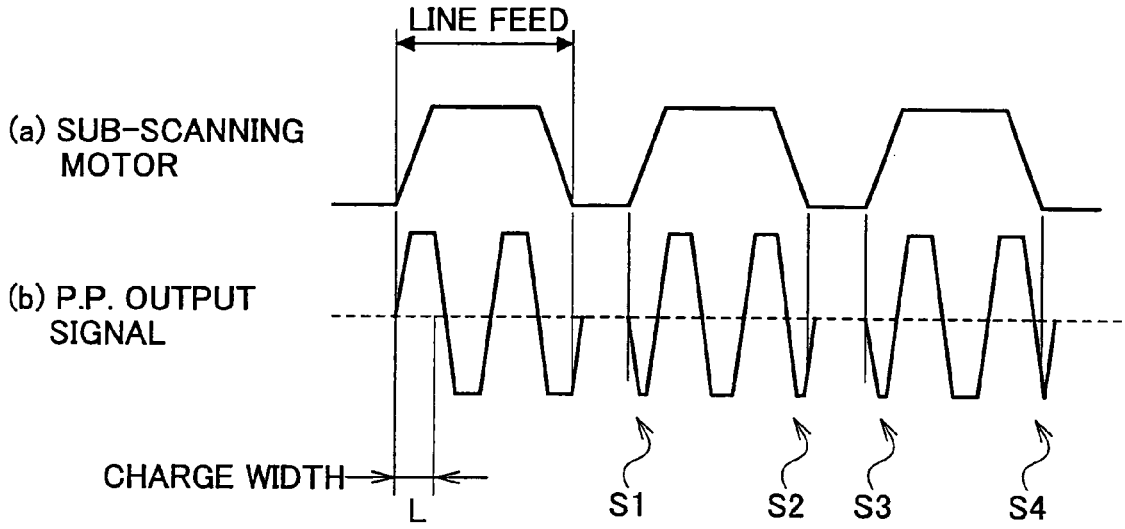
FIG. 9 is a time chart for explaining a charge control during a line feed operation.

Therefore, if a charge voltage of the same polarity is applied during line feed, it becomes impossible to achieve an optimum charge width. Thus, as shown in FIG. 9, if an amount of movement (line feed amount) of the conveyance belt 21 is not an integral multiple of the charge width is smaller than an amount of a single line feed, the output of the high-voltage circuit (high-voltage power source) 83 is switched between plus and minus as shown in FIG. 9-(*a*) while the conveyance belt 21 is driven (moved by driving the sub-scanning motor 31 as shown in FIG. 9-(*b*).

Then, if the line feed is completed without completely charging at the desired charge width, the remaining uncharged portion is charged during a subsequent line feed in the same polarity. Since, in the example of FIG. 9, the remaining uncharged portion is charged in a portion S1 and an uncharged portion in a portion S2 remains in the line feed concerned, the remaining uncharged portion at S2 is charged in a portion S3 in a subsequent line feed.

As mentioned above, even when the line feed is stopped while forming a charge at a constant width, a desired charge having a desired charge width can be formed by switching the polarities of the charge during the line feed. Thus, a stable attraction force can be obtained, which results in a stable conveyance property.

Moreover, if it is set to charge the charge belt 21 during line feed (while moving the conveyance belt 21 by a predetermined amount), a charge width may be set so that an amount of movement of the conveyance belt 21 for a line feed during an image formation is an integral multiple of the charge width.

Figure 10:
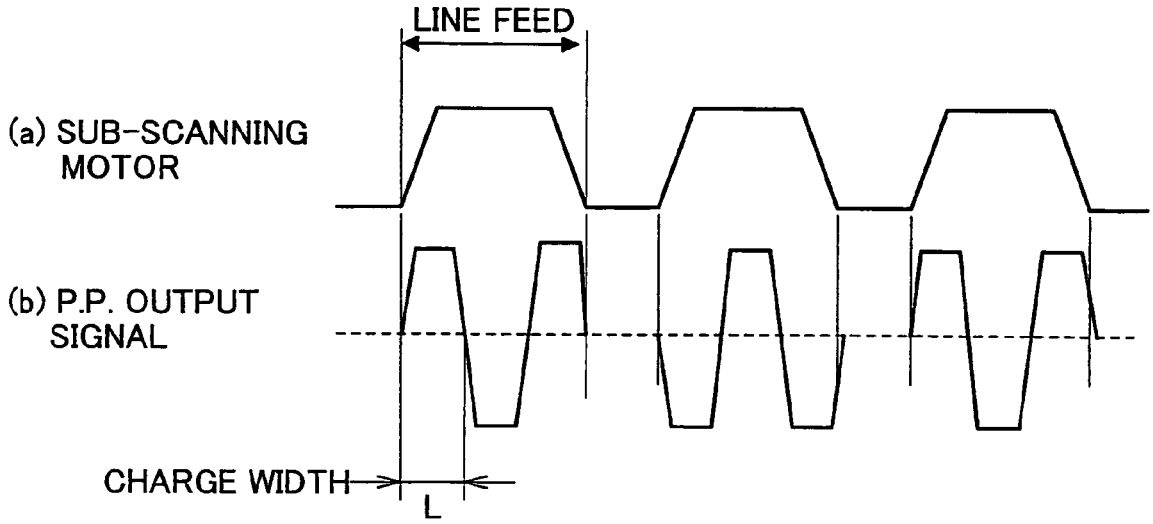
FIG. 10 is a time chart for explaining another charge control during a line feed operation.

Here, the amount of line feed is determined by a pixel density of an image to be formed and a nozzle pitch and a number of nozzles of the recording head 4. Usually, in an image forming apparatus using an inkjet head, a plurality of pixel densities are selectable. If the charge width is set to 1/n of a greatest common divisor of the line feed amounts provided by an image forming apparatus, the formation of the charges at the charge width can always be completed during each line feed as shown in FIG. 10. In this way, there is no need to perform a charging operation for a very short time as shown in FIG. 9.

That is, since the switching of polarity is performed during line feed in the example explained with reference to FIG. 9, if the line feed amount is not an integral multiple of the charge width, a charge of the same polarity is applied over two line feeds. Then, as shown in FIG. 9, it is possible that a charge voltage is applied for an extremely short time (a portion indicated by S4 in the figure), and an amount of charge charged at that time may not satisfy a desired amount.

That is, according to such a charging operation for an extremely short time, a desired charge potential may not be formed on the conveyance belt 21 through the charge roller 26 even if the output of the high-voltage circuit 83 is raised to a desired voltage. Accordingly, the charge potential may be lower than a desired level, and the charging operation may be ended before the potential of the portion to be charged is not sufficiently raised.

On the other hand, if the charge width is set so that the line feed amount is an integral multiple of the charge width as shown in FIG. 10, the charge of the same polarity is not applied over two line feeds and the charge area is charged with a desired charge width at once. Thus, the amount of charge on the conveyance belt can be a desired amount, which achieves stabilization of the potential level.

Figure 11:
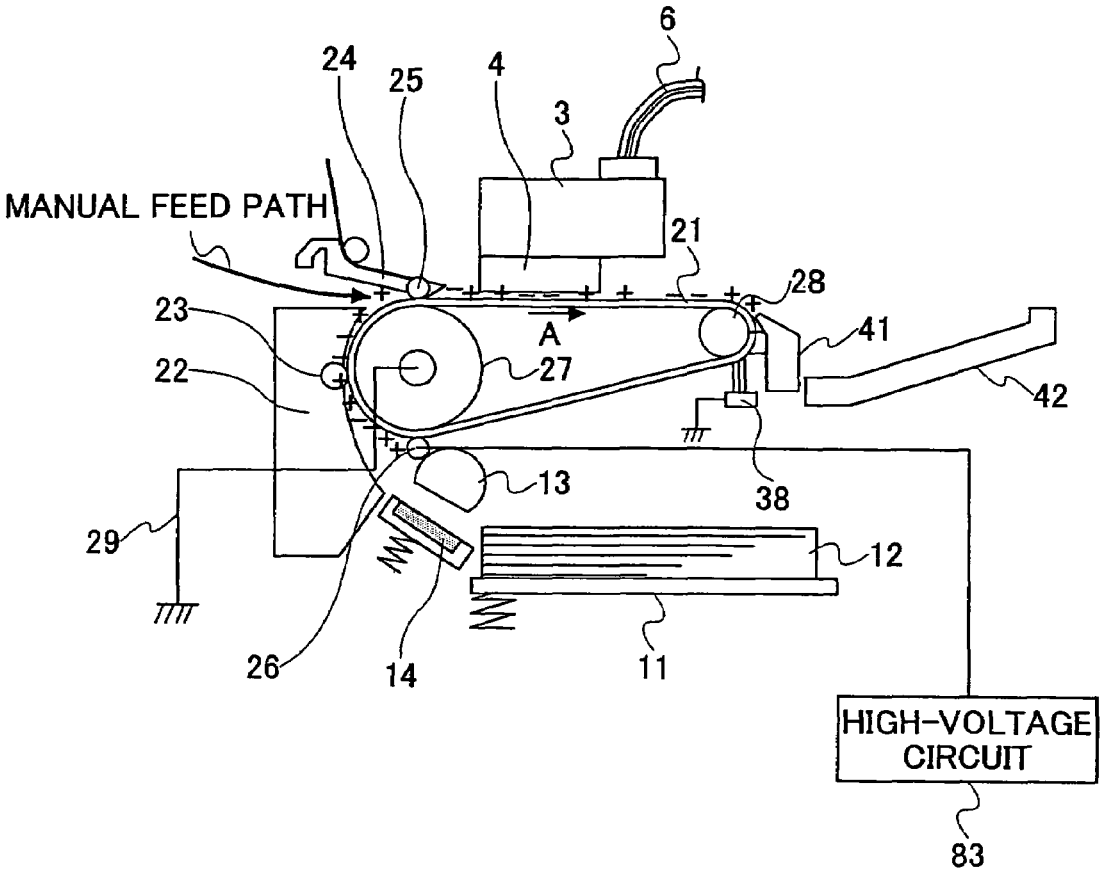
FIG. 11 is a structural diagram for explaining an inkjet recording apparatus according to a second embodiment of the present invention.

A description will now be given, with reference to FIG. 11, of an inkjet recording apparatus as an image forming apparatus according to a second embodiment of the present invention. In this embodiment, a discharge device such as a discharge brush for removing a residual charge on the conveyance belt 21. It should be noted that the discharge device 38 is electrically connected to a housing of the inkjet recording apparatus or the like.

Therefore, electric charges after the separation of a recording paper is removes by the discharge device 38 when the conveyance belt 21 is moved while forming electric charges of plus and minus on the conveyance belt 21. Thereby, when charging the conveyance belt 21 by the charge roller 26, there is no charge formed on the conveyance belt, which stabilizes the charge and improves the durability of the conveyance belt 21.

That is, if charges of plus and minus (charge voltage pattern) are alternately formed on the entire surface of the conveyance belt 21, a potential of the surface of the conveyance belt 21 in an area where the conveyance belt 21 is in contact with the recording paper 12 decreases when the separation of the recording paper 12 is performed.

However, a charge remains on the surface of the conveyance belt 21 in an area which is not brought into contact with the recording paper 12 since the area is located between the adjacent recording papers 12. If a charge having a polarity opposite to the polarity of the remaining charge should be formed in that area, there is a potential difference as large as twice the voltage to be applied.

Generally, there is a small destruction of an insulating layer due to attack of the charge on the surface of the conveyance belt. If the charge is applied with a potential difference as large as twice the voltage normally applied as mentioned above, the magnitude of attack increases, which may result in an adverse effect to the durability of the conveyance belt 21. Thus, by providing the discharge device 38 so as to set a state where no electric charge is formed on the conveyance belt 21 when a charging operation is performed, there is no need to apply a charge with a potential difference of about twice the normally applied voltage, thereby improving the durability of the conveyance belt 21.

Moreover, when conveying the recording paper 12, there is a case, as mentioned below, where it is not desirable to form a charge in a portion of the conveyance belt corresponding to a specific portion of the recording paper 12. In such a case, a control can be performed so that a charge is formed only on specific portions of the conveyance belt by using a discharge mechanism having the discharge device.

A description will now be given, with reference to FIG. 12, of a control of a charged area when conveying a recording paper, which is a high-resistance object having a high surface resistivity (exceeding $1\times10^{12}$ Ω/□) in the inkjet recording apparatus. In this case, a leading edge portion LE of the recording paper conveyed is detected, and a charge is applied only to a portion corresponding to a leading edge portion (equal to or less than 50 mm) and a portion corresponding to a trailing edge portion TE (equal to or less than 100 mm) so as to form an uncharged area 93 therebetween.

With this apparatus, since the discharge device 38 for removing a charge on the conveyance belt 21 is provided, a charge is never formed in the uncharged area 93 on the conveyance belt 21.

Therefore, when the recording paper 12, which is a high-resistance object, is conveyed by the conveyance belt 21, the leading edge portion LE and a trailing edge portion TE of the recording paper are electrostatically attached onto the conveyance belt 21. In many cases, the recording paper 12, which is a high-resistance object to be conveyed, contains a resin, and the balance of the recording paper 12 will not be off due to an image formation by ink. Thus, there is less necessity of electrostatically attaching the recording paper 12 onto the conveyance belt 21. The leading edge portion LE is electrostatically attached onto the conveyance belt 21 since is it necessary to form an image in a state where the position of the recording paper is not maintained well. In addition to the above-mentioned reason, the trailing edge portion is electrostatically attached onto the conveyance belt 21 since it is required to surely eject the recording paper into the paper eject tray 42 after the image recording.

As mentioned above, when conveying the recording paper, which is a high-resistance object to be conveyed, only the leading and trailing edge portions LE and TE are electrostatically attracted by the conveyance belt. Accordingly, also when the recording paper is separated from the conveyance belt, an electric charge due to a release discharge may be generated on the surface of the recording paper at the leading and trailing edge portions. However, such a recording paper having an electric charge on the leading and trailing edge portions can be stacked without electrostatic attachment with a high-resistance object previously ejected from the apparatus since the charged area due to the release discharge.

That is, when a recording paper having a high surface resistivity ($1\times10^{12}$ Ω/□) is conveyed by electrostatically attaching to the conveyance belt, the release discharge is generated between the charges on the surface of the recording paper and the charges on the conveyance belt when the recording paper is separated from the conveyance belt since the charges on the surface of the recording paper do not easily moves. If such a release discharge occurs, the portions of the recording paper, which has been in contact with the conveyance belt 21, are charged. As a result, when the recording paper is separated and ejected onto the paper eject tray, the ejected recording paper may be electrostatically attached to recording papers previously ejected and stored in the paper eject tray, which may give a bad influence such as causing eject of the recording papers stored in the paper eject tray or causing a conveyance resistance to a recording paper being conveyed.

Then, when the recording paper, which is a high-resistance object, is conveyed, portions of the conveyance belt corresponding to the leading and trailing edge portions are charged so that only the leading and trailing edge portions LE and TE of the recording paper are attached onto the conveyance belt. That is, portions other than the leading and trailing edge portions are not charged so as to decrease the charged area generated by a release discharge to a level causing no problem in the conveyance. Thereby, the electrostatic attraction between the ejected recording paper and recording papers previously ejected onto the paper eject tray is prevented, thereby improving stackability and conveyance property.

Furthermore, by setting the charge width of the charge voltage pattern formed on the conveyance belt to be equal to or smaller than 2 mm, a condition can be established in which no charge is formed on the conveyance belt. Although it is possible to cancel a charge formed on the conveyance belt by the next charge of the opposite polarity, this charge may act to discharge also the conveyance belt having a residual charge thereon.

Figure 12:
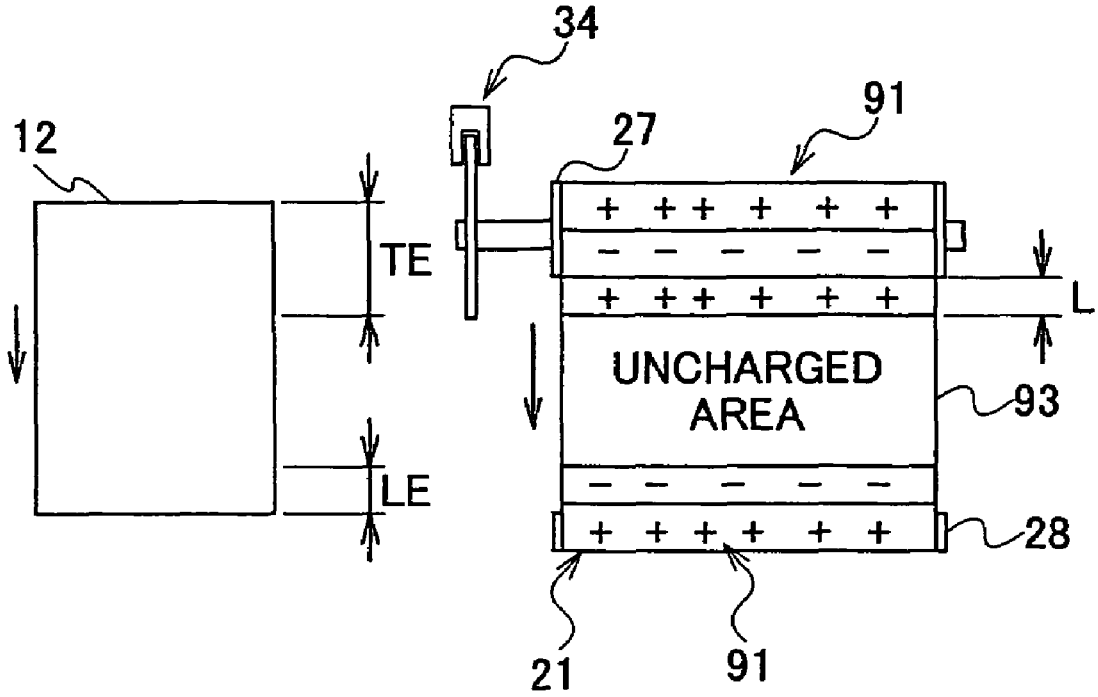
FIG. 12 is a plan view of a conveyance belt for explaining a charge control performed for a high-resistance object in the inkjet recording apparatus shown in FIG. 11.

Although the above-mentioned charge control as shown in FIG. 12 is performed when conveying the high-resistance object, there may exist a residual charge of a certain level in the uncharged area 93 depending on the effect of the discharge device. In such a case, if a high frequency voltage with a pitch of 2 mm or less is applied on to the conveyance belt, the conveyance belt can be forcibly discharged so as to form an uncharged area without using the discharge device.

That is, as shown in FIG. 12, as for the charge control operation, the charged area of the conveyance belt 21 corresponding to the leading edge portion LE of the recording paper 12 is charged at a normal charge width; a high-frequency voltage is applied at a timing of charging the uncharged area; and the charged area of the conveyance belt 21 corresponding to the trailing edge portion TE is charged at the normal charge width. Thus, by controlling the charge width in accordance with a distance from the leading edge of the recording paper, the charge voltage pattern 91 can be formed only on a desired portion of the recording paper.

Although the present invention is applied to the inkjet recording apparatus of a serial type (shuttle type) in which a carriage is scanned in the above-mentioned embodiments, the present invention is also applicable to a line-type inkjet recording apparatus having a line-type head.

Moreover, the image forming apparatus according to the present invention is applicable to a facsimile apparatus, a copy apparatus and a printer/fax/copy combination machine besides an inkjet printer. Furthermore, the present invention is applicable to an apparatus that injects a liquid other than ink, such as, for example a resist or a DNA sample in a medical field.

The present invention is not limited to the specifically disclosed embodiments, and variations and modifications may be made without departing from the scope of the present invention.

The invention claimed is:

1. A sheet conveyance apparatus for conveying a sheet, the sheet conveyance apparatus comprising:

an endless conveyance belt;

a charger that charges a surface of said endless conveyance belt in a belt-like alternate voltage pattern having alternate polarities; and a control part that controls a charge width of the alternate voltage pattern in a direction of conveyance of the sheet, wherein said control part controls the charge width in accordance with a type of said sheet, wherein said control part controls the charge width so that the charge width when the sheet contains a resin is smaller than the charge width when the sheet contains no resin.

2. The sheet conveyance apparatus as claimed in claim 1, further comprising a sheet-type input part that inputs information regarding the type of said sheet to said control part.

3. The sheet conveyance apparatus as claimed in claim 1, wherein information regarding the type of said sheet is given externally.

4. A sheet conveyance apparatus for conveying a sheet, the sheet conveyance apparatus comprising:

an endless conveyance belt;

a charger that charges a surface of said endless conveyance belt in a belt-like alternate voltage pattern having alternate polarities; and a control part that controls a charge width of the alternate voltage pattern in a direction of conveyance of the sheet, wherein said control part controls the charge width in accordance with a type of said sheet, wherein said control part controls the charge width so that the charge width when a surface resistivity of the sheet is equal to or smaller than $1\times10^{10}$ Ω/□ is set to be substantially equal to or greater than 4 mm and equal to or smaller than 30 mm, and the charge width when a surface resistivity of the sheet is great than $1\times10^{10}$ Ω/□ is set to be substantially equal to or greater than 2 mm and substantially equal to or smaller than 8 mm.

5. A sheet conveyance apparatus for conveying a sheet, the sheet conveyance apparatus comprising:

an endless conveyance belt;

a charger that charges a surface of said endless conveyance belt in a belt-like alternate voltage pattern having alternate polarities; and a control part that controls a charge width of the alternate voltage pattern in a direction of conveyance of the sheet, wherein said conveyance belt has a two-layer structure comprising an insulating layer as an obverse layer and a medium resistance layer as a backside layer.

6. A sheet conveyance apparatus as claimed in claim 5, wherein said control part controls the charge width in accordance with a type of said sheet.

7. The sheet conveyance apparatus as claimed in claim 5, wherein a surface resistivity of said insulating layer is substantially equal to or greater than $1\times10^{10}$ Ω/□, and a surface resistivity of said medium resistance layer is substantially equal to or smaller than $1\times10^{10}$ Ω/□.

8. The sheet conveyance apparatus as claimed in claim 5, wherein a thickness of said insulating layer is substantially equal to or smaller than 60 μm, and a thickness of said backside layer is substantially equal to or greater than 40 μm.

9. The sheet conveyance apparatus as claimed in claim 5, wherein a volume resistivity of a roller with which said conveyance belt is engaged in substantially equal to or smaller than $1\times10^{10}$ Ω·cm.

10. The sheet conveyance apparatus as claimed in claim 5, further comprising a discharger that removes or attenuates the charges on the surface of said conveyance belt, wherein said discharger is located on an obverse side of said conveyance belt and a position out of an area where said sheet is brought into contact with said conveyance belt.

11. A sheet conveyance apparatus for conveying a sheet, the sheet conveyance apparatus comprising:

an endless conveyance belt;

a charger that charges a surface of said endless conveyance belt in a belt-like alternate voltage pattern having alternate polarities; and a control part that controls a charge width of the alternate voltage pattern in a direction of conveyance of the sheet, wherein said control part controls a charged area of said conveyance belt when a surface resistivity of said sheet is substantially equal to or greater than $1\times10^{12}$ Ω/□ so that at least one of a leading edge portion and a trailing edge portion of said sheet is attached onto said conveyance belt, the leading edge portion being a range from a leading edge of said sheet to a position substantially equal to or less than 50 mm from the leading edge and the trailing edge portion being a range from a trailing edge of said sheet to a position substantially equal to or less than 100 mm from the trailing edge.

12. A sheet conveyance apparatus for conveying a sheet, the sheet conveyance apparatus comprising:

an endless conveyance belt;

a charger that charges a surface of said endless conveyance belt in a belt-like alternate voltage pattern having alternate polarities; and a control part that controls a charge width of the alternate voltage pattern in a direction of conveyance of the sheet, wherein said control part controls the charge with so that the charge width is changed in accordance with a distance from a leading edge of said sheet.

13. An image forming apparatus for forming an image on a sheet conveyed by a sheet conveyance apparatus, the image forming apparatus comprising:

an endless conveyance belt;

a charger that charges a surface of said endless conveyance belt in a belt-like alternate voltage pattern having alternate polarities; and a control part that controls a charge width or the alternate voltage pattern in a direction of conveyance of the sheet, wherein said control part controls said charger to stop a charging operation to said conveyance belt while an image is being formed on said sheet, and controls said charger to perform the charging operation on said conveyance belt when conveying said sheet by a specific distance, and wherein the charge width of said voltage pattern is an integral multiple of an amount of movement of said conveyance belt when conveying said sheet by the specific distance.

14. The image forming apparatus as claimed in claim 13, wherein said conveyance belt is charged before said sheet is fed to said conveyance belt.

15. The image forming apparatus as claimed in claim 13, wherein said control part controls said charger to change a polarity of each charge in said voltage pattern in accordance with an amount of movement of said conveyance belt when said sheet is conveyed by the specific distance.

16. An image forming apparatus for forming an image on a sheet conveyed by a sheet conveyance apparatus, the sheet conveyance apparatus comprising:

an endless conveyance belt;

a charger that charges a surface of said endless conveyance belt in a belt like alternate voltage pattern having alternate polarities;

a storing part that stores a relationship between a type of said sheet and a charge width of the alternate voltage pattern to be formed on the conveyance belt; and a control part that controls a charge width of the alternate voltage pattern in a direction of conveyance of the sheet in accordance with the type of said sheet based on said relationship stored in said storing part.

17. The image forming apparatus as claimed in claim 16, wherein said control part controls said charger to stop a charging operation to said conveyance belt while an image is being formed on said sheet, and controls said charger to perform the charging operation on said conveyance belt when conveying said sheet by a specific distance.

* * * * *